US011211751B1

(12) United States Patent
Torrey et al.

(10) Patent No.: US 11,211,751 B1
(45) Date of Patent: Dec. 28, 2021

(54) CONDUCTIVE CONTACT HAVING A PERIPHERAL SEAL

(71) Applicant: TE Connectivity Services GmbH, Schaffhausen (CH)

(72) Inventors: Eric J. Torrey, Troy, MI (US); Hurley Chester Moll, Middletown, PA (US)

(73) Assignee: TE Connectivity Services GmbH

( * ) Notice: Subject to any disclaimer, the term of this patent is extended or adjusted under 35 U.S.C. 154(b) by 0 days.

(21) Appl. No.: 16/899,944

(22) Filed: Jun. 12, 2020

(51) Int. Cl.
*H01R 13/6596* (2011.01)
*H01R 13/52* (2006.01)
*H01R 13/62* (2006.01)

(52) U.S. Cl.
CPC ..... *H01R 13/6596* (2013.01); *H01R 13/5202* (2013.01); *H01R 13/62* (2013.01)

(58) Field of Classification Search
CPC .. H01R 13/52; H01R 13/5202; H01R 13/521; H01R 13/5219; H01R 13/62; H01R 13/6596
See application file for complete search history.

(56) References Cited

U.S. PATENT DOCUMENTS

| | | | | |
|---|---|---|---|---|
| 4,138,183 | A * | 2/1979 | Soos | H01R 13/533 439/161 |
| 5,224,875 | A * | 7/1993 | Watanabe | H01R 13/5205 439/587 |
| 5,433,628 | A * | 7/1995 | Sadaishi | H01R 4/64 29/883 |
| 6,773,272 | B2 | 8/2004 | Koehler et al. | |
| 7,080,990 | B1 | 7/2006 | Juntwait et al. | |
| 9,197,004 | B2 * | 11/2015 | Kuo | H01R 13/5202 |
| 10,455,712 | B1 | 10/2019 | Malecke et al. | |
| 2013/0217262 | A1 * | 8/2013 | Ikeda | H01R 25/162 439/559 |
| 2015/0180158 | A1 * | 6/2015 | Arai | H01R 13/521 439/588 |

* cited by examiner

*Primary Examiner* — Oscar C Jimenez

(57) ABSTRACT

An electrical contact and a connector assembly for housing the contact. The electrical contact has a first mating section, a transition section, a securing section. The first mating section extends in a plane which is substantially parallel to a plane of the securing section. The transition section extends in a plane which is substantially perpendicular to the plane of the first mounting section. The first mating section has a mating contact engaging portion and a seal receiving portion. A seal retention projection extends from the seal receiving portion. A peripheral seal is provided on the seal receiving portion of the first mating section of the electrical contact. The housing includes a contact receiving area and a connector mating area. A wall is provided between the contact receiving area and the connector mating area. The wall has a contact receiving opening which extends through the wall.

21 Claims, 6 Drawing Sheets

CONDUCTIVE CONTACT HAVING A PERIPHERAL SEAL

FIELD OF THE INVENTION

The present invention is directed to a conductive contact having a peripheral seal. In particular, the invention relates to a seal positioned on a contact, such as a grounding lug, for use with a non-overmolded housing.

BACKGROUND OF THE INVENTION

When assembling an electrical connector to a mating electrical connector or panel, the positioning of the male blades of the terminals of the electrical connector must be controlled to ensure proper mating of the terminals of the electrical connector to mating terminals of the mating electrical connector or panel. Properly controlling the positioning of the male blades of the terminals minimizes the possibility of stubbing the terminals and the mating terminals as mating occurs. This is particularly important in connectors with numerous terminals.

In order to more precisely control the location of the terminals and the components, the housing of the electrical connector may be manufactured using an overmolded process. In so doing, the location of the terminals and components can be controlled. In addition, in environments in which vibration occurs, the over-molded housing does not allow unwanted movement of the terminals or components during use.

While providing an overmolded housing is beneficial in many instances, the incorporation of grounding lugs into an overmolded housing can require the use of expensive tooling machines and process to provide proper sealing in applications and environments in which sealing is required.

It would be, therefore, be beneficial to provide a contact, such as a ground lug, and seal which can be positioned in a housing, and in particular an overmolded housing, without the need for expensive tooling machines and process.

SUMMARY OF THE INVENTION

An embodiment is directed to an electrical contact. The electrical contact has a first mating section, a transition section, a securing section and a second mating section. The first mating section extends in a plane which is substantially parallel to a plane of the securing section. The transition section extends in a plane which is substantially perpendicular to the plane of the first mounting section. The first mating section has a mating contact engaging portion and a seal receiving portion. A seal retention projection extends from the seal receiving portion.

The electrical contact may have a peripheral seal provided on the seal receiving portion of the first mating section of the electrical contact. The peripheral seal may be made from a compliant material with a durometer of 50 or more. The peripheral seal has a first surface and an oppositely facing second surface. A top surface, a bottom surface and side surfaces extend between the first surface and the second surface. A plurality of sealing projections extend from the top surface, the bottom surface and the side surfaces. Free ends of the sealing projections form ridges which extend about the periphery of the peripheral seal. A recess is provided between adjacent sealing projections.

An embodiment is directed to a connector assembly having a housing and a contact. The housing includes a contact receiving area and a connector mating area. A wall is provided between the contact receiving area and the connector mating area. The wall has a contact receiving opening which extends through the wall. A positioning projection extends from the wall into the contact receiving area. A securing portion has securing recesses. The contact includes a first mating section, a transition section and a securing section. The first mating section has a mating contact engaging portion and a seal receiving portion. A seal retention projection extending from the seal receiving portion. A peripheral seal is provided on the seal receiving portion of the first mating section of the electrical contact.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
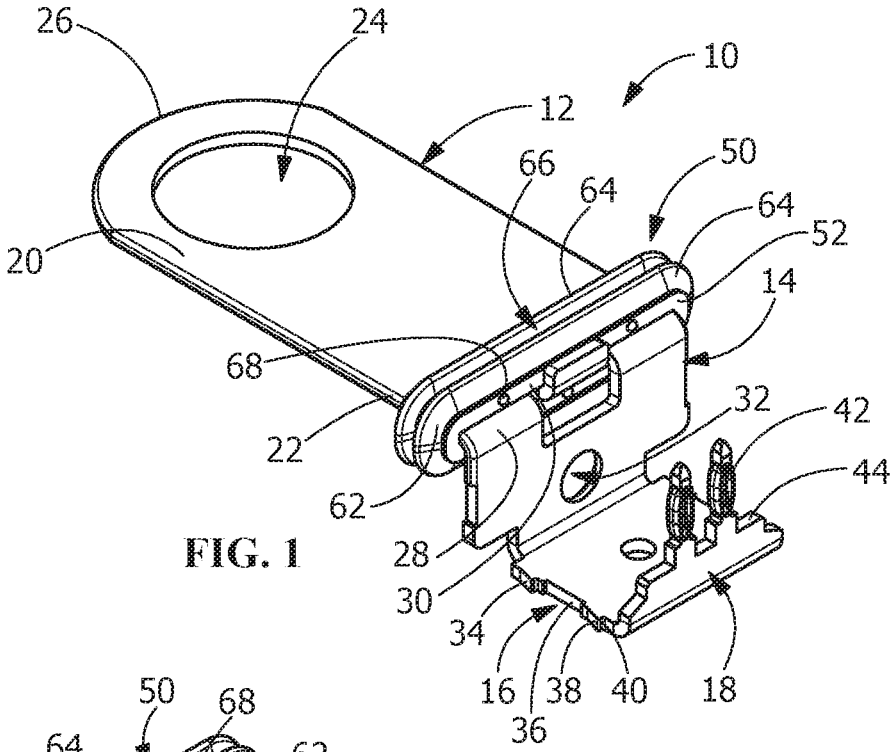
FIG. 1 is a perspective view of an illustrative ground lug and seal according to the present invention.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Moreover, the features and benefits of the invention are illustrated by reference to the preferred embodiments.

Accordingly, the invention expressly should not be limited to such embodiments illustrating some possible non-limiting combination of features that may exist alone or in other combinations of features, the scope of the invention being defined by the claims appended hereto.

Figure 2:
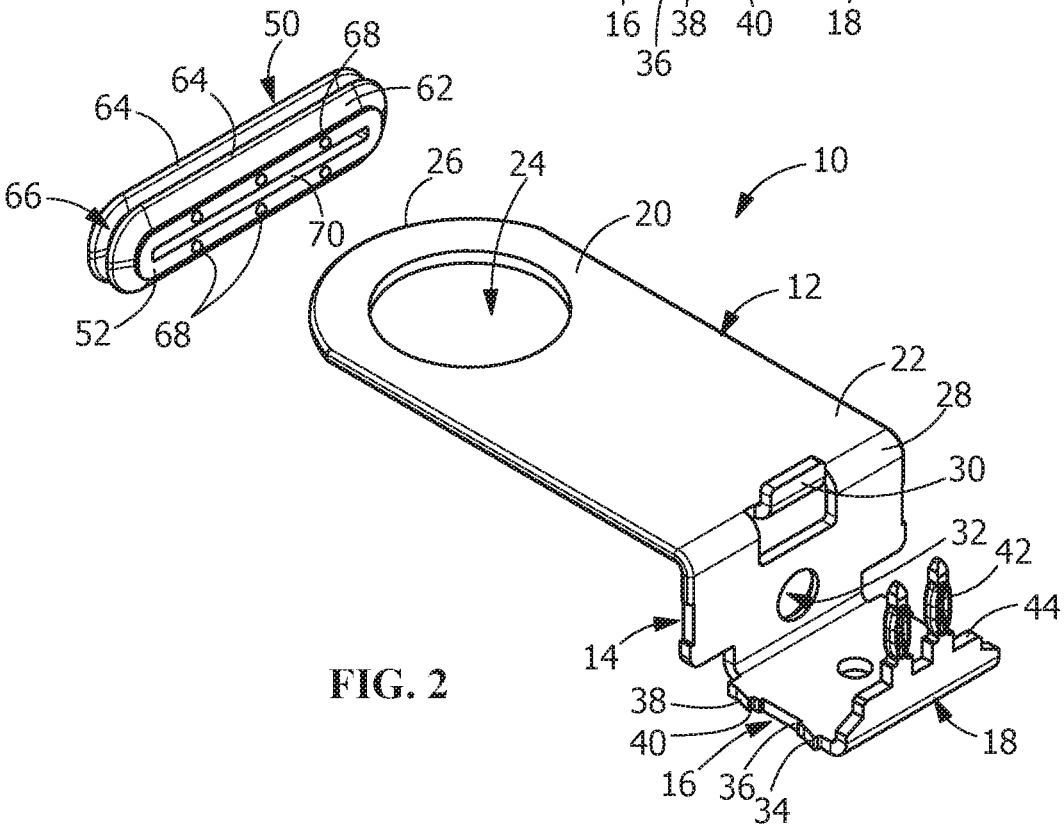
FIG. 2 is a perspective view of the ground lug of FIG. 1 with the seal removed.

As shown in FIGS. 1 and 2, an electrical contact 10 has a first mating section 12, a transition section 14, a securing section 16 and a second mating section 18. In the embodiment shown, the first mating section 12 extends in a plane which is substantially parallel to a plane of the securing section 16, and the transition section 14 extends in a plane which is substantially parallel to a plane of the second mating section 18. However, other configurations of the electrical contact may be used without departing from the scope of the invention. In the illustrative embodiment shown, the electrical contact 10 is a grounding lug made of conductive material, such as a copper tin alloy, but the invention is not so limited.

The first mating section 12 has a mating contact engaging portion 20 and a seal receiving portion 22. The first mating section 12 has a circular opening 24 positioned proximate a free end 26 of the first mating section 12. In alternate embodiments, the opening 24 may have different configurations or may be replaced by a mating projection. The first mating section 12 and the opening 24 are configured to physically and electrically engage a mating contact (not shown).

The seal receiving portion 22 extends from a fixed end 28. Portions of the fixed end 28 are integrally attached to the transition portion 14. A seal retention projection 30 also extends from the fixed end 28. The seal retention projection 30 extends from the first mating section 12 in a direction which is substantially perpendicular to the plane of the first mating section 12.

The transition section 14 extends from the first mating section 12 in a direction which is substantially perpendicular to the plane of the first mating section 12. The transition section 14 extends from the first mating section 12 in substantially the opposite direction as the seal retention projection 30. A projection receiving opening 32 extends through the transition section 14.

The securing section 16 extends from the transition section 14 in a direction which is substantially perpendicular to the plane of the transition section 14. Retention projections or barbs 34 extend from side walls 36 of the securing section 16. The retention projections 34 have sloped or lead-in surfaces 38 and locking shoulders 40.

The second mating section 18 extends from the securing section 16 in a direction which is substantially perpendicular to the plane of the securing section 16. Mating contact engagement portions 42 extend from a free end 44 of the second mating section 18. In the illustrative embodiment shown, the mating contact engagement portions 42 are compliant pins. However, other types of contact engagement portions 42 may be used.

Figure 3:
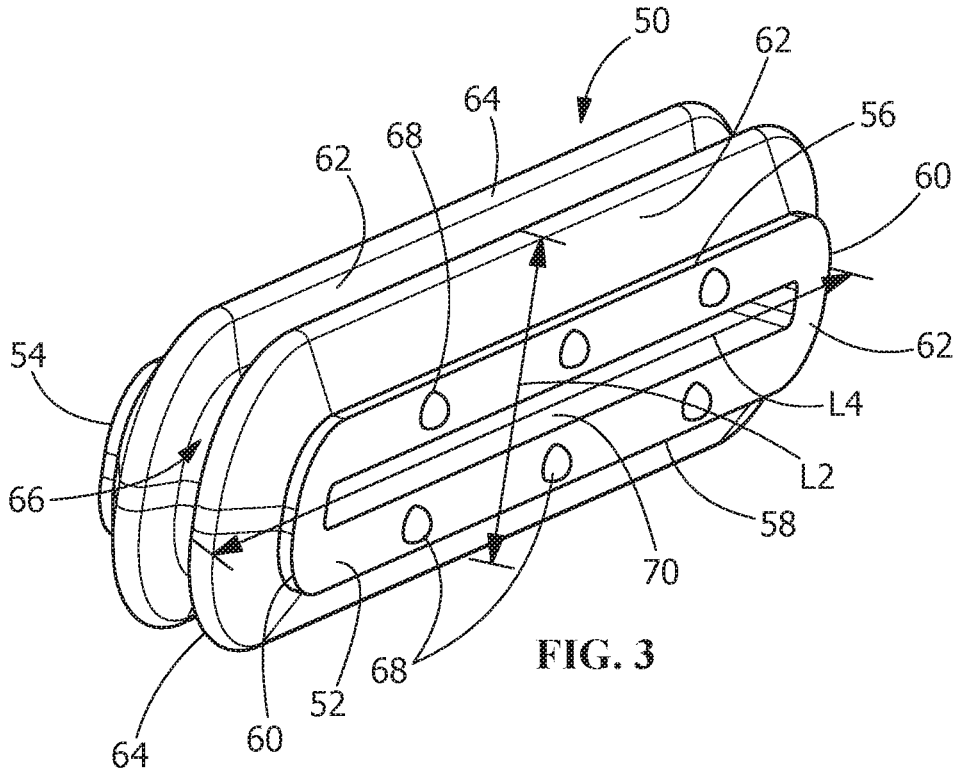
FIG. 3 is a perspective view of the seal of FIG. 1.

A peripheral seal 50 is provided on the electrical contact 10, as shown in FIG. 1. The peripheral seal 50 is made from a compliant material which prevent the ingress of water therethrough, such as, but not limited to, liquid silicon rubber with a durometer of 50 or more. The peripheral seal 50, as shown in FIGS. 2 and 3, has a first surface 52 and an oppositely facing second surface 54. A top surface 56, a bottom surface 58 and side surfaces 60 extend between the first surface 52 and the second surface 54. The top surface 56, the bottom surface 58 and the side surfaces 60 have a plurality of sealing projections 62 which extend about the periphery of the peripheral seal 50. Free ends of the projections 62 form ridges 64. The ridges extend about the periphery of the peripheral seal 50 and are positioned on the top surface 56, the bottom surface 58 and the side surfaces 60. A recess 66 is provided between adjacent projections 62. Projections 68 extend outward from both the first surface 52 and the second surface 54. In the illustrative embodiment shown, the projections 68 are round and are spaced periodically around the first surface 52 and the second surface 54, although other configurations and spacing of the projections 68 may be used.

A slot or opening 70 extends from the first surface 52 to the second surface 54. The slot 70 is spaced equidistant from the top surface 56 and the bottom surface 58. The slot 70 is spaced equidistant from the side surfaces 60.

Figure 8:
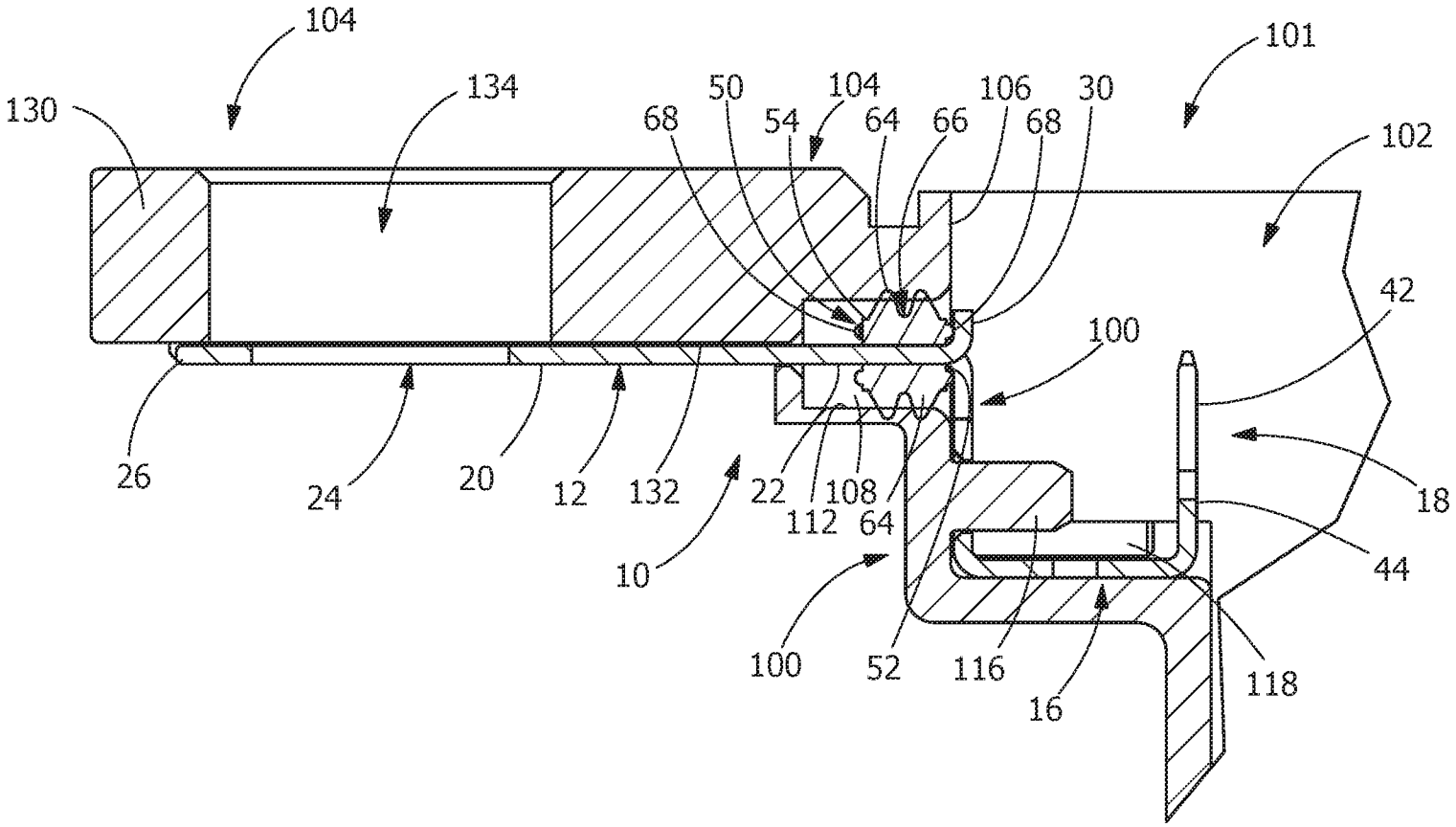
FIG. 8 is a cross-sectional view of the portion of the housing with the ground lug and seal fully inserted taken along line 8-8 of FIG. 7.

In use, the peripheral seal 50 is initially positioned on the first mating section 12 of the electrical contact 10. As this occurs, the mating contact engagement portions 20 of the first mating section 12 is inserted in the slot 70 of the peripheral seal 50. The peripheral seal 50 is then moved to a fully inserted position, as shown in FIGS. 1 and 8. In the fully inserted position, the peripheral seal 50 is positioned on the seal receiving portion 22 of the first mating section 12. In this position, the projections 68 of the first surface 52 are in engagement with the seal retention projection 30 and the transition section 14.

The slot 70 is dimensioned to be smaller than the periphery of the mating contact engagement portions 20 of the first mating section 12. However, as the peripheral seal 50 is made from compliant material, the top surface 56, the bottom surface 58 and the side surfaces 60 deform to allow the slot 70 to expand and conform to the shape of the seal receiving portion 22 of the first mating section 12, causing the peripheral seal 50 to exert a force on the seal receiving portion 22 to create a seal therebetween, thereby providing a water tight connection between the peripheral seal 50 and the seal receiving portion 22 of the first mating section 12 of the contact 10.

Figure 4:
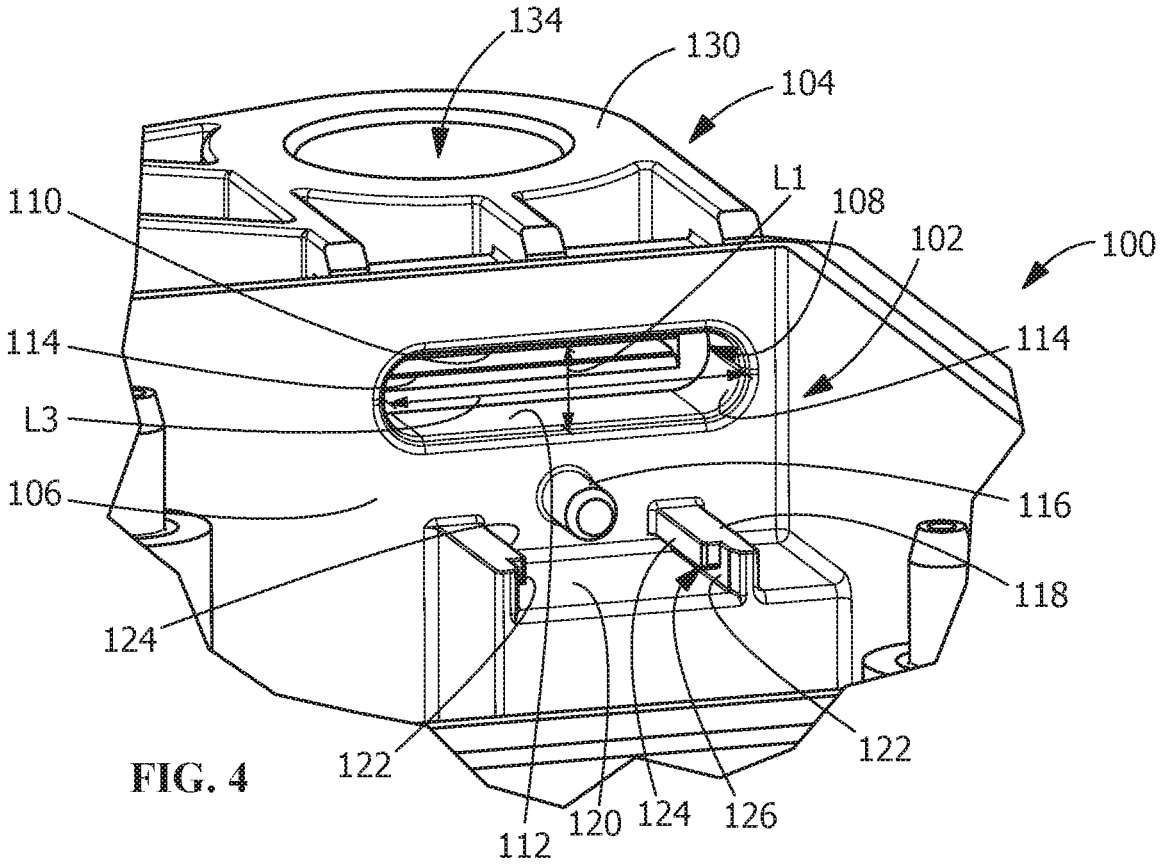
FIG. 4 is a perspective view of a portion of a housing illustrating a ground lug receiving area and a seal receiving opening.
Figure 5:
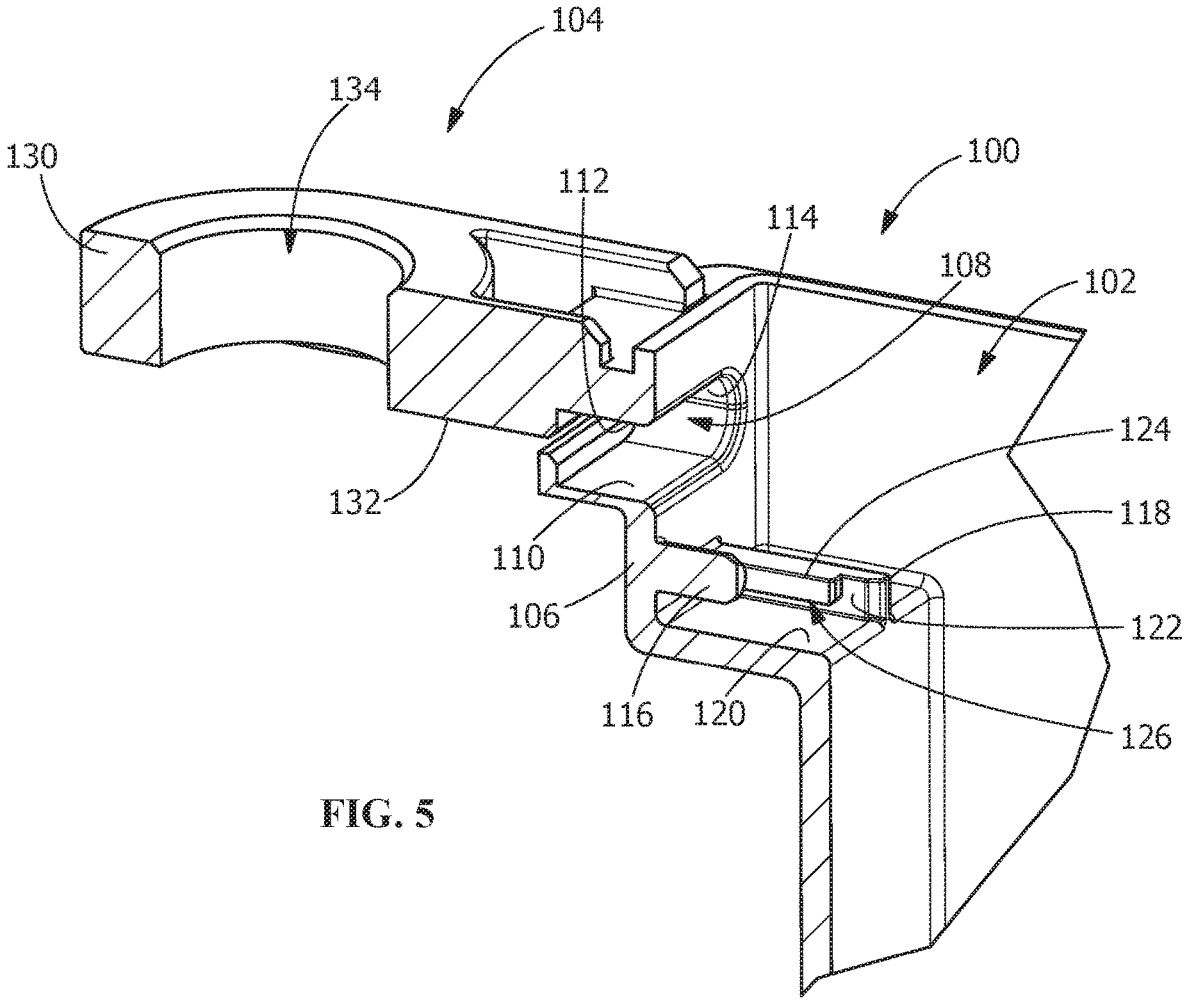
FIG. 5 is a cross-sectional view of the portion of the housing taken along line 5-5 of FIG. 4.

Referring to FIGS. 4 and 5, a portion of a housing 100 is shown. The housing 100 has a contact receiving area 102 and a connector mating area 104. The contact receiving area 102 is configured to receive the contact 10 therein, as will be more fully described. The housing 100 is made from dielectric material. In the illustrative embodiment shown, the housing 100 is manufactured using an overmolded process. However, the housing 100 may be manufactured using other processes.

A wall or partition 106 is provided between the contact receiving area 102 and the connector mating area 104. The wall 106 has a contact receiving opening 108 which extends therethrough. The opening 108 has a top wall 110, a bottom wall 112 and side walls 114. The spacing L1 (FIG. 4) between the top wall 110 and the bottom wall 112 is less than the spacing L2 (FIG. 3) between the ridges 64 which extend from the top surface 56 and the bottom surface 58 of the peripheral seal 50. The spacing L3 (FIG. 4) between the side walls 114 is less than the spacing L4 (FIG. 3) between the ridges 64 which extend from opposed side surfaces 60 of the peripheral seal 50.

A positioning projection 116 extends from the wall 106 into the contact receiving area 102. In the illustrative embodiment, the positioning projection 116 has a generally cylindrical configuration, however, other configurations may be used. The positioning projection 116 is positioned between the opening 108 and a securing portion 118 of the contact receiving area 102.

The securing portion 118 has a bottom wall 120 and side walls 122. The bottom wall 120 and side walls 122 extend from the wall 106. In the illustrative embodiment shown, the bottom wall 120 and side walls 122 extend at substantially right angles from the wall 106. Projections 124 extend from the side walls 122. The projections 124 are spaced from the bottom wall 120, thereby forming securing recesses 126 between the projections 124 and the bottom wall 120.

The connector mating area 104 has a flange 130 with a contact positioning surface 132. An opening 134 extends through the flange 130 to the contact positioning surface 132.

Figure 6:
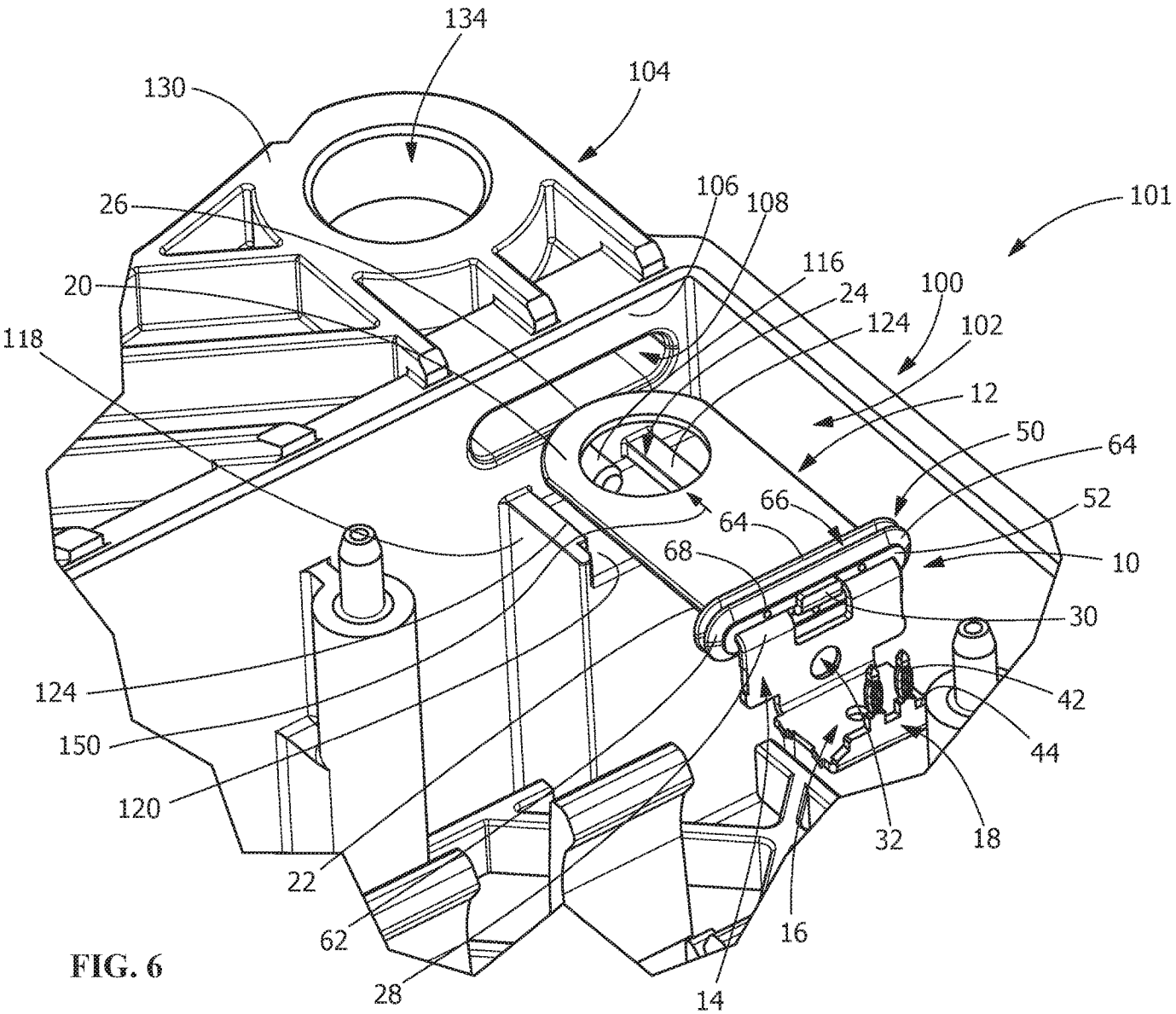
FIG. 6 is a perspective view of the portion of the housing with the ground lug and seal positioned in line with the ground lug receiving area and the seal receiving opening.

With the peripheral seal 50 properly mounted to the contact 10, as described above, the assembled contact 10 is moved into the contact receiving area 102, as shown in FIG. 6. In this position, the contact 10 is positioned in line with the opening 108. The contact 10 is then inserted or moved in the direction of arrow 150, as shown in FIG. 6.

As the contact 10 is moved in the direction of arrow 150, the free end 26 of the first mating section 12 is moved into the opening 108. As insertion continues, the securing section 16 of the contact 10 is received in the securing portion 118 of the housing 100. As this occurs, the projections 124 guide the side walls 36 of the securing section 16 into the securing recesses 126 to facilitate proper positioning of the contact 10. The projections 124 cooperate with the side walls 36 to prevent the movement of the securing section 16 and the contact 10 in a direction perpendicular to the insertion of the contact 10.

As insertion continues, the barbs 34 projecting from the side walls 36 of the securing section 16 are moved or slide into the securing recess 126. As this occurs, the lead-in surfaces 38 of the barbs 34 dig in or displace material in the side walls 122 of the securing portion 118. When fully inserted, the locking shoulders 40 engage the side walls 122 to prevent the unwanted removal of the contact 10 from the fully inserted position.

As the contact is moved in the direction of the arrow 150, the projection receiving opening 32 of the transition section 14 is moved engagement with the positioning projection 116 which extends from the wall 106 of the housing 100. As the positioning projection 116 is received in the projection receiving opening 32, the positioning projection 116 guides the contact 10 as the contact 10 is inserted, thereby facilitating the proper final position of the contact 10 relative to the housing 100.

As the contact is moved in the direction of the arrow 150, the peripheral seal 50 is moved into the opening 108. The engagement of the projections 68 of the first surface 52 with the transition section 14 and the seal retention projection 30 causes the peripheral seal 50 to be moved with the contact 10 as the contact 10 is moved in the direction of arrow 150.

As the peripheral seal 50 enters the opening 108, the ridges 64 of the projections 60 of the peripheral seal 50 are deformed or compressed by the walls 110, 112, and 114 of the housing 110. The compression of the ridges 64 causes the ridges 64 to exert a force on the walls 110, 112, and 114, thereby forming a seal between the peripheral seal 50 and the opening 108 the housing 100, as shown in FIG. 8.

Insertion of the contact 10 continues until the transition wall 14 of the contact 10 is provided in engagement with the wall 106 of the housing 100. With the transition wall 14 in contact with the wall 106, the contact 10 is fully inserted into the housing 100, as shown in FIGS. 7 and 8.

Figure 7:
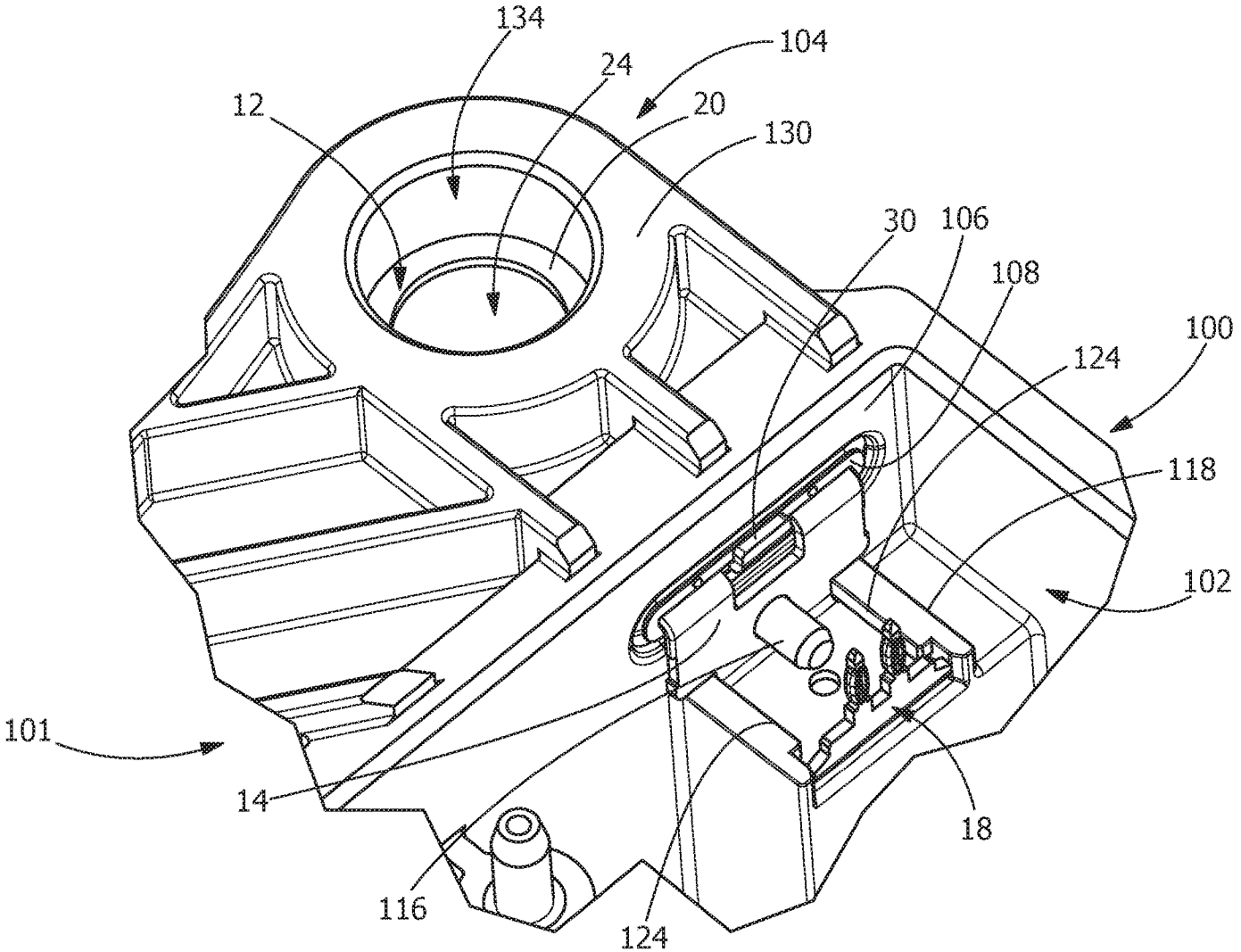
FIG. 7 is a perspective view of the portion of the housing with the ground lug and seal fully inserted and retained in the ground lug receiving area and the seal receiving opening.

With the contact 10 fully inserted into the housing 100, as shown in FIGS. 7 and 8, the mating contact engaging portion 20 of the contact 10 is positioned proximate to or in engagement with the contact positioning surface 132 of the flange 130 of the housing 100. In this position, the opening 24 of the mating contact engaging portion 20 is in alignment with the opening 134 of the flange 130. The seal receiving portion 22 of the first mating section 12 and the peripheral seal 50 are positioned in the opening 108. As previously stated, the peripheral seal 50 exerts a force and the opening 108 the housing 110 to create a seal therebetween. In addition, the peripheral seal 50 exerts a force on the seal receiving portion 22 to create a seal therebetween. Consequently, a watertight seal is provided to prevent the ingress of moisture or other contaminants into the contact receiving area 102 and other interior portions of the housing 100 from the outside of the housing 100.

In the fully inserted position, the projection receiving opening 32 of the transition section 14 engages the positioning projection 116 which extends from the wall 106 of the housing 100 to prevent the movement of the contact 10 in a direction which is transverse to a longitudinal axis of the positioning projection 116. In addition, the locking shoulders 40 of the barbs 34 engage the side walls 122 of the securing portion 118 of the housing 100 to prevent the unwanted removal of the contact 10 from the fully inserted position.

The use of the contact, contact assembly and the housing allows for the contact, such as, but not limited to, a ground lug to be positioned in a housing and sealed without the need for expensive tooling machines and process. In particular, this can be beneficial when the housing is overmolded.

One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. An electrical contact comprising:

a first mating section, a transition section, a securing section and a second mating section, the transition section extending between the first mating section and the securing section, the second mating section extending from the securing section;

the first mating section extending in a plane which is different from, but substantially parallel to a plane of the securing section, and the transition section extending in a plane which is substantially perpendicular to the plane of the first mating section;

the first mating section having a mating contact engaging portion and a seal receiving portion, a seal retention projection extending from the seal receiving portion.

2. The electrical contact as recited in claim 1, wherein the electrical contact is a grounding lug made of conductive material.

3. The electrical contact as recited in claim 1, wherein the first mating section has an opening positioned proximate a free end of the first mating section.

4. The electrical contact as recited in claim 1, wherein the seal retention projection extends from the first mating section in a direction which is substantially perpendicular to the plane of the first mating section.

5. The electrical contact as recited in claim 1, wherein a projection receiving opening extends through the transition section.

6. The electrical contact as recited in claim 1, wherein the securing section has retention projections which extend from side walls of the securing section.

7. The electrical contact as recited in claim 6, wherein the retention projections have lead-in surfaces and locking shoulders.

8. The electrical contact as recited in claim 1, wherein the second mating section extends from the securing section in a direction which is substantially perpendicular to the plane of the securing section.

9. The electrical contact as recited in claim 8, wherein mating contact engagement portions extend from a free end of the second mating section, the mating contact engagement portions are compliant pins.

10. The electrical contact as recited in claim 1, wherein a peripheral seal is provided on the seal receiving portion of the first mating section of the electrical contact.

11. The electrical contact as recited in claim 10, wherein the peripheral seal is made from a compliant material with a durometer of 50 or more.

12. The electrical contact as recited in claim 10, wherein:

the peripheral seal a first surface and an oppositely facing second surface;

a top surface, a bottom surface and side surfaces extend between the first surface and the second surface;

a plurality of sealing projections extend from the top surface, the bottom surface and the side surfaces, free ends of the sealing projections form ridges, a recess is provided between adjacent sealing projections.

13. The electrical contact as recited in claim 12, wherein second projections extend outward from both the first surface and the second surface.

14. A connector assembly comprising:

a housing comprising:

a contact receiving area and a connector mating area;

a wall provided between the contact receiving area and the connector mating area, the wall having a contact receiving opening which extends through the wall, a positioning projection extending from the wall into the contact receiving area;

a securing portion having securing recesses;

a contact comprising:

a first mating section, a transition section and a securing section;

the first mating section having a mating contact engaging portion and a seal receiving portion, a seal retention projection extending from the seal receiving portion;

a peripheral seal provided on the seal receiving portion of the first mating section of the electrical contact;

the transition section having a projection receiving opening;

the securing section having side walls;

wherein the projection receiving opening of the transition section engages the positioning projection and the side walls of the securing section are positioned in the securing recesses to prevent the unwanted removal of the contact from the housing.

15. The connector assembly as recited in claim 14, wherein the mating contact engaging portion of the contact is positioned proximate to a contact positioning surface of a flange of the connector mating area of the housing.

16. The connector assembly as recited in claim 14, wherein the seal receiving portion of the first mating section and the peripheral seal are positioned in the contact receiving opening, wherein the peripheral seal exerts a force on the seal receiving portion of the first mating section and contact receiving opening to provide a watertight seal to prevent the ingress of moisture or other contaminants into the contact receiving area of the housing.

17. The connector assembly as recited in claim 14, wherein the projection receiving opening of the transition section engages the positioning projection which extends from the wall of the housing to prevent the movement of the contact in a direction which is transverse to a longitudinal axis of the positioning projection.

18. The connector assembly as recited in claim 14, wherein locking shoulders of retention projections of the securing section of the contact engage side walls of the securing portion of the housing to prevent the unwanted removal of the contact from the housing.

19. The connector assembly as recited in claim 18, wherein the securing portion extends from the wall, the securing portion having a bottom wall and side walls, securing projections extending from the side walls, the securing projections being spaced from the bottom wall to form the securing recesses between the securing projections and the bottom wall.

20. The connector assembly as recited in claim 18, wherein the first mating section of the contact extends in a plane which is substantially parallel to a plane of the securing section, and the transition section extends in a plane which is substantially perpendicular to the plane of the first mating section.

21. An electrical contact comprising:

a first mating section, a transition section, a securing section and a second mating section;

the first mating section extending in a plane which is substantially parallel to a plane of the securing section, and the transition section extending in a plane which is substantially perpendicular to the plane of the first mating section;

the first mating section having a mating contact engaging portion and a seal receiving portion, a seal retention projection extending from the seal receiving portion;

a peripheral seal provided on the seal receiving portion of the first mating section of the electrical contact, the peripheral seal having a top surface, a bottom surface and side surfaces extend between the first surface and the second surface;

a plurality of sealing projections extending from the top surface, the bottom surface and the side surfaces, free ends of the sealing projections forming ridges, a recess provided between adjacent sealing projections.

* * * * *